US011112193B2

(12) United States Patent
O'Clair

(10) Patent No.: US 11,112,193 B2
(45) Date of Patent: Sep. 7, 2021

(54) MAGAZINE HAVING SPACER WITH DETENT FASTENER

(71) Applicant: Smith & Wesson Inc., Springfield, MA (US)

(72) Inventor: Sean O'Clair, Blandford, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 17/126,298

(22) Filed: Dec. 18, 2020

(65) Prior Publication Data

US 2021/0190447 A1 Jun. 24, 2021

Related U.S. Application Data

(60) Provisional application No. 62/950,182, filed on Dec. 19, 2019.

(51) Int. Cl.
*F41A 9/65* (2006.01)

(52) U.S. Cl.
CPC ..... *F41A 9/65* (2013.01)

(58) Field of Classification Search
CPC ..... F41A 9/65; F41A 9/71
See application file for complete search history.

(56) References Cited

U.S. PATENT DOCUMENTS

| | | | | |
|---|---|---|---|---|
| 4,592,160 | A | 6/1986 | Bross | |
| 4,862,619 | A * | 9/1989 | Baldus | F41A 9/71 42/7 |
| 5,438,783 | A | 8/1995 | Sniezak et al. | |
| 5,566,487 | A | 10/1996 | Vaid et al. | |
| 7,093,386 | B1 | 8/2006 | Vieweg | |
| 7,200,963 | B1 | 4/2007 | Vieweg | |
| 7,908,780 | B2 | 3/2011 | Fitzpatrick et al. | |
| 8,069,601 | B1 | 12/2011 | Fitzpatrick et al. | |
| 8,635,796 | B2 | 1/2014 | Fitzpatrick et al. | |
| 8,839,543 | B2 | 9/2014 | Fitzpatrick et al. | |
| 8,863,423 | B2 | 10/2014 | Clifton, Jr. et al. | |
| 8,991,086 | B2 | 3/2015 | Fitzpatrick et al. | |
| 9,746,264 | B2 | 8/2017 | Fitzpatrick et al. | |
| 10,048,030 | B2 | 8/2018 | Corso | |
| 10,072,903 | B2 | 9/2018 | Fitzpatrick et al. | |
| 10,190,835 | B2 | 1/2019 | Hsu et al. | |
| 10,240,893 | B2 | 3/2019 | Henderson et al. | |
| 10,317,153 | B2 | 6/2019 | Faifer | |
| 10,393,457 | B2 | 8/2019 | Fitzpatrick et al. | |
| 10,480,880 | B2 * | 11/2019 | Thomele | F41A 9/69 |
| 2017/0321979 | A1 * | 11/2017 | Szczepkowski | F41A 9/71 |

* cited by examiner

*Primary Examiner* — Joshua T Semick
(74) *Attorney, Agent, or Firm* — John A. Chionchio, Esq.; Ballard Spahr LLP

(57) ABSTRACT

An ammunition magazine for a firearm uses a spacer to extend the grip. The spacer is attached to the magazine's tube using a combined fastener and detent mechanism which acts between the magazine's butt plate and floor plate. The butt plate is attached to the magazine tube and the spacer is captured between the butt plate and floor plate.

11 Claims, 3 Drawing Sheets

MAGAZINE HAVING SPACER WITH DETENT FASTENER

CROSS REFERENCE TO RELATED APPLICATIONS

This application is based upon and claims benefit of priority to U.S. Provisional application No. 62/950,182, filed Dec. 19, 2019, which application is hereby incorporated by reference herein.

FIELD OF THE INVENTION

This invention relates to mechanisms for securing butt plates to floor plates in magazines for firearms.

BACKGROUND

Extended ammunition magazines, i.e., magazines which extend outwardly beyond the end of the grip of a semiautomatic pistol for increased ammunition capacity, advantageously use a spacer attached to the magazine which acts as an extension of the grip to ensure secure and comfortable purchase between the hand and the firearm. There is an opportunity to improve the strength and simplicity of the attachment of the spacer to the magazine.

SUMMARY

This invention concerns an ammunition magazine for feeding ammunition to a firearm. In an example embodiment, the magazine comprises a tube surrounding a central space. The tube has a first and a second end oppositely disposed. A first opening is positioned at the first end of the tube providing access to the central space. A butt plate is attached to the first end of the tube and overlies the first opening. A spacer surrounds the tube proximate to the first end thereof. The spacer engages the butt plate. A floor plate is positioned within the tube and engages the spacer. A fastener acts between the butt plate and the floor plate, attaching the butt plate to the floor plate and capturing the spacer therebetween.

As an example, the tube comprises a pair of lips positioned opposite to one another at the first end thereof. The butt plate comprises a pair of slots positioned in spaced relation and opposite to one another. The slots receive the lips for attaching the butt plate to the tube.

In an example, the floor plate comprises a first tab extending from a first end of the floor plate and a second tab extending from a second end of the floor plate opposite to the first end of the floor plate. The spacer comprises a first shoulder positioned at a first end of the spacer and a second shoulder positioned at a second end of the spacer opposite to the first end of the spacer. The first tab engages the first shoulder and the second tab engages the second shoulder.

As an example, the fastener comprises a slot positioned in the butt plate. A projection extends from the floor plate toward the butt plate. The projection has a head in spaced relation to the floor plate. The head has a width wider than a width of the slot. The projection engages the slot to retain the butt plate to the floor plate.

In an example, the slot extends along a line between the first and second ends of the floor plate. In a particular example, the projection comprises a fin extending along a line between the first and the second ends of the floor plate. In another particular example, the projection has a "T" shaped cross sectional shape.

As an example, the fin comprises a first recess extending transversely to the fin. The butt plate comprises a first protrusion contiguous with the slot, the first recess receives the first protrusion for retaining the fin within the slot. In a particular example, a second recess extends transversely to the fin in a opposite direction to the first recess. A second protrusion is contiguous with the slot, the second protrusion being positioned on an opposite side of the slot from the first protrusion. The second recess receives the second protrusion for retaining the fin within the slot.

In an example, the magazine further comprises a follower positioned within the central space and movable toward and away from the second end of the tube. A spring acts between the follower and the floor plate for biasing the follower toward the second end of the tube.

As an example, the magazine further comprises a third tab extending from the first end of the floor plate. The third tab is offset from the first tab toward the butt plate. A recess is positioned at a first end of the butt plate. The recess receives the third tab for fixing the butt plate to the floor plate.

DETAILED DESCRIPTION

Figure 1:
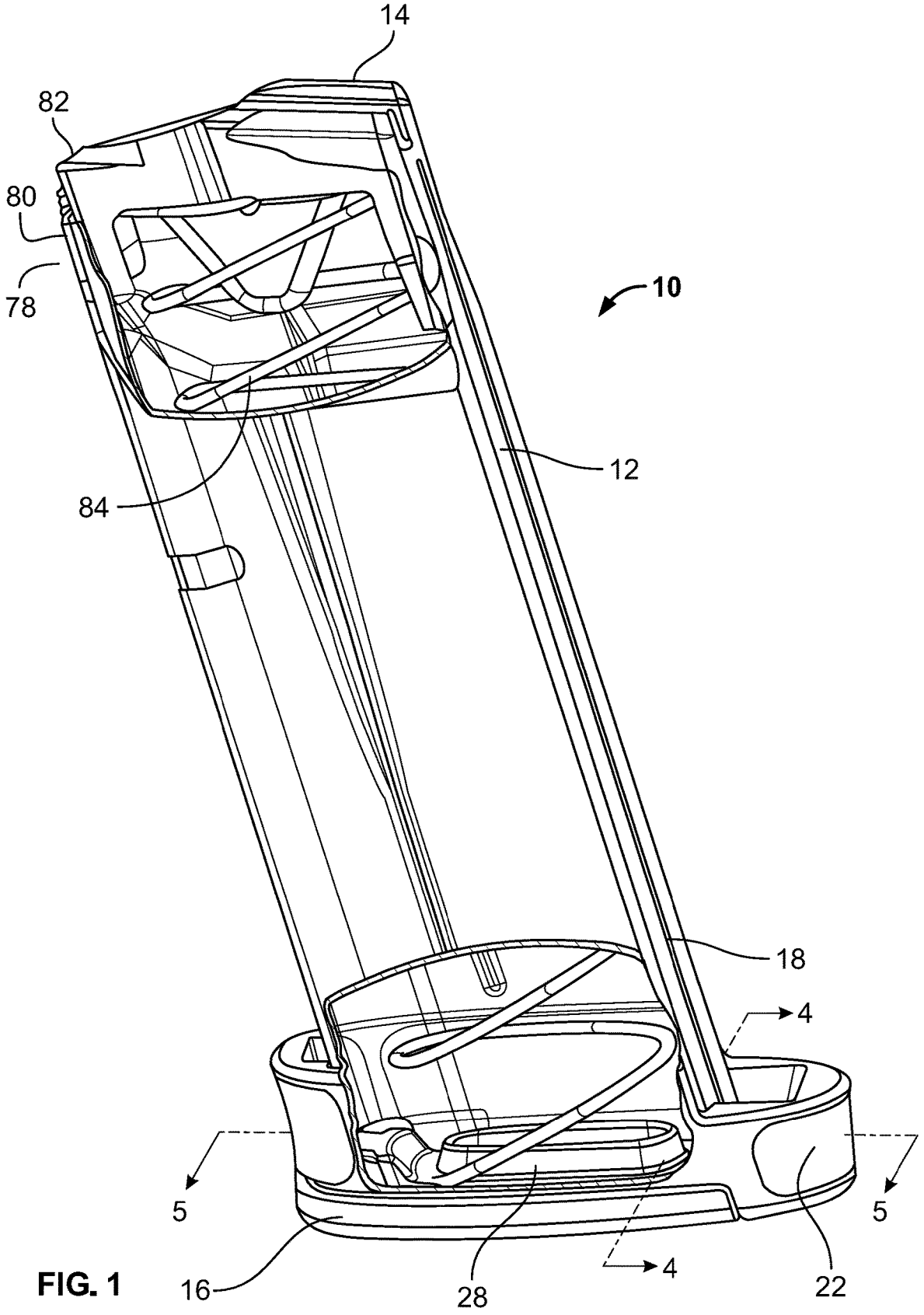
FIG. 1 shows a partial cutaway isometric view of an example ammunition magazine according to the invention.
Figure 2:
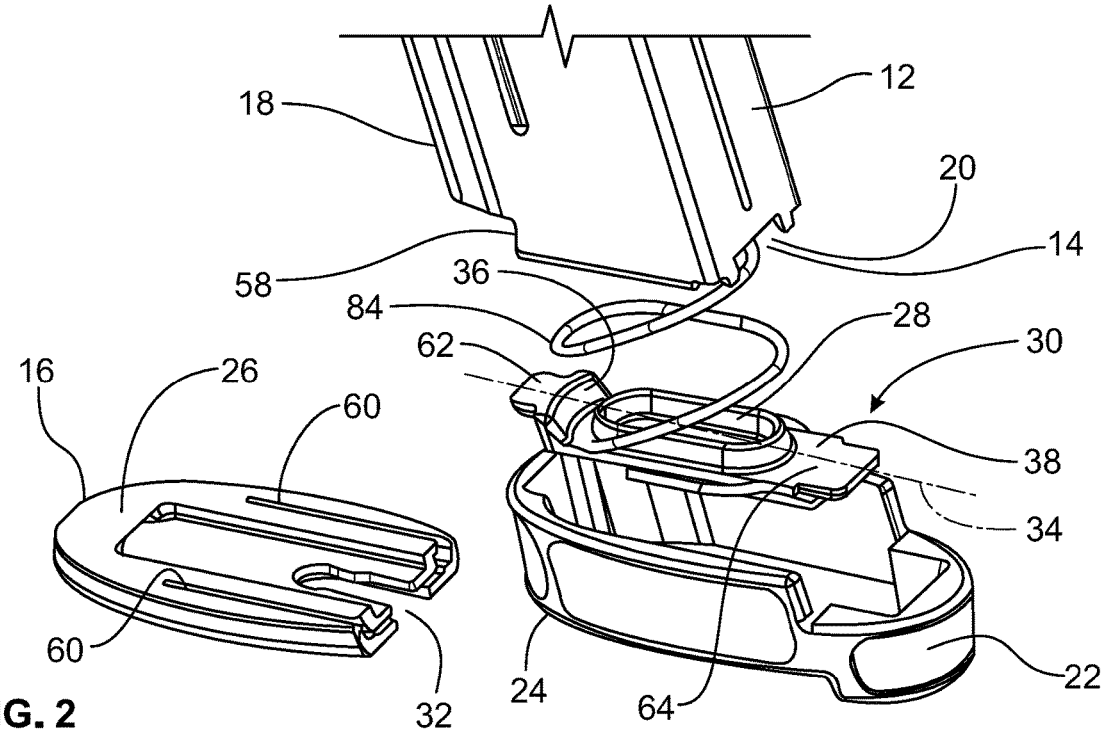
FIG. 2 is an exploded isometric view of a portion of the magazine shown in FIG. 1.
Figure 3:
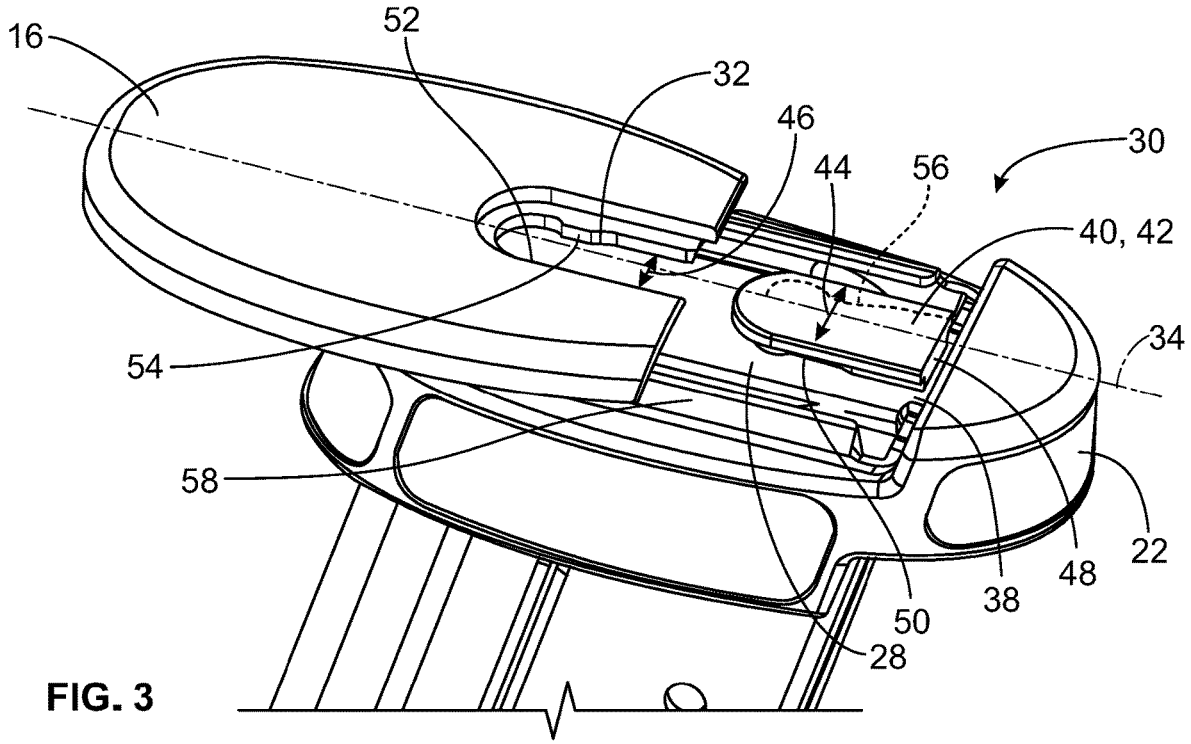
FIG. 3 is an isometric view of a portion of the magazine shown in FIG. 1 illustrating the assembly of the magazine.

FIG. 1 shows an example embodiment of an ammunition magazine 10 according to the invention. Magazine 10 is also known as a "box" magazine and comprises a tube 12 surrounding a central space 14 for receiving ammunition (not shown). As shown in FIGS. 1 and 2, magazine 10 comprises a butt plate 16 attached to a first end 18 of tube 12. Butt plate 16 overlies a first opening 20 positioned at the first end 18 of the tube 12, the first opening providing access to the central space 14. A spacer 22 surrounds tube 14 proximate to the first end 18. A lower surface 24 of the spacer 22 engages an upper surface 26 of the butt plate 16. As further shown in FIG. 2, a floor plate 28 is positioned within the central space 14 of the tube 12. The floor plate 28 engages the spacer 22. As shown in FIG. 3, a fastener 30 acts between the butt plate 16 and the floor plate 28. Fastener 30 attaches the butt plate 16 to the floor plate 28 and thereby captures the spacer 22 therebetween.

Figure 4:
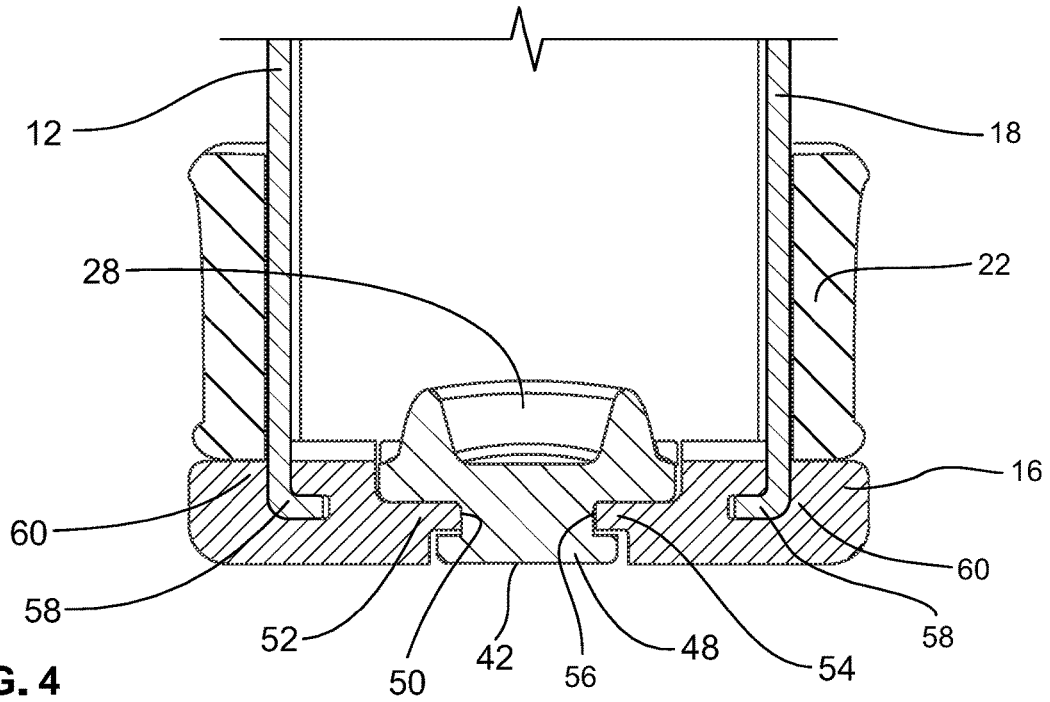
FIG. 4 shows a cross section view taken at lines 4-4 of FIG. 1.

FIGS. 2 and 3 show an example fastener 30 which acts between the butt plate 16 and the floor plate 28. Fastener 30 comprises a slot 32 positioned within the butt plate 16. The slot 32 extends along a line 34 between a first end 36 and a second end 38 of the floor plate 28. As shown in FIG. 3, fastener 30 further comprises a projection 40 which extends from the floor plate 28 toward the butt plate 16. The projection 40 has a head 42 positioned in spaced relation to the floor plate 28. Head 42 has a width 44 wider than the width 46 of slot 32. Head 42 provides mechanical engagement with the butt plate 16 for retention of the butt plate to the floor plate 28 when the projection 40 engages the slot 32. In this example embodiment the projection 40 comprises a fin 48 which also extends along line 34 between the first and second ends 36 and 38 of the floor plate 28, thereby allowing sliding engagement when the slot 32 receives the fin 48. As shown in FIGS. 3 and 4, when viewed in cross section the fin 48 and head 42 have a "T" shaped cross section. The fin and slot design permits the fastener 30 to include a detent mechanism which takes the form of a recess 50 in fin 48, the recess extending transversely to the fin (see FIG. 3).

As shown in FIGS. 3 and 4 the butt plate 16 comprises a protrusion 52 contiguous with the slot 32. The recess 50 receives the protrusion 52 when the fin 48 engages the slot 32 and inhibits, but does not prevent, sliding motion for retaining the fin 48 within the slot 32 consistent with the function of a detent. The detent embodiment shown includes a second protrusion 54, also contiguous with the slot 32, and positioned on an opposite side of the slot from the first protrusion 52. When the fin 48 engages the slot 32 the second protrusion 54 is received within a second recess 56 extending transversely to the fin 48 in an opposite direction to the first recess 50.

Detents require biasing action to permit engagement and disengagement between their inter-fitting parts. In the example shown in FIG. 3 the inter-fitting parts are protrusions 52 and 54 with recesses 50 and 56, and the biasing action is in the flexibility of the butt plate 16. In use, when attaching the butt plate 16 to the floor plate 28 and capturing the spacer 22 therebetween, the slot 32 of the butt plate 16 is slid toward the projection 40 of the floor plate 28. The slot 32 widens as the protrusions 52 and 54 engage the fin 48. When the fin 48 is received within the slot 32, the protrusions 52 and 54 snap into the respective recesses 50 and 56 as the butt plate 16 slides into the position relative to the floor plate 28 as shown in FIGS. 1 and 4.

FIG. 3 shows butt plate 16 disengaged from floor plate 28. When disengaging the butt plate 16 from the floor plate 28, the slot 32 of the butt plate 16 is slid away from the projection 40 of the floor plate 28. The slot 32 widens as the protrusions 52 and 54 disengage the fin 48. When the fin is released from the slot 32, the protrusions 52 and 54 move out of the respective recesses 50 and 56 as butt plate 16 slides out of position relative to the floor plate 28.

FIGS. 2 and 4 show in detail how butt plate 16 is attached to the tube 12. Tube 12 comprises a pair of oppositely disposed lips 58 positioned at the first end 18 of tube 12. Butt plate 16 comprises a pair of slots 60 positioned in spaced relation from and opposite to one another on opposite sides of the butt plate 16. As shown in FIG. 4, the slots 60 receive the lips 58 in sliding engagement for attaching the butt plate 16.

Figure 5:
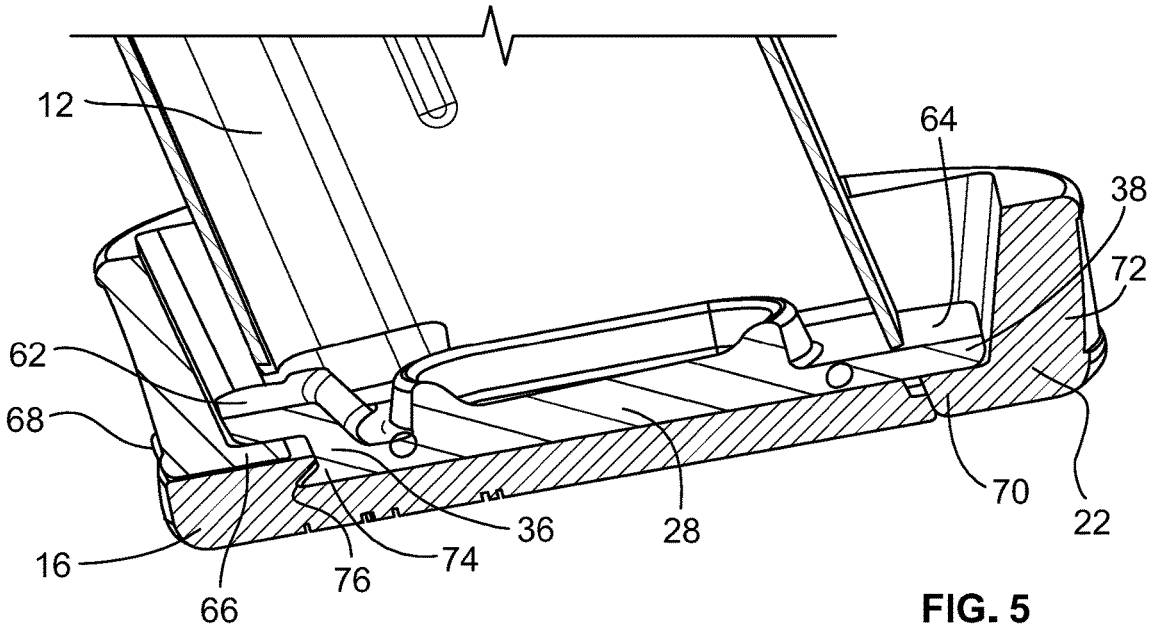
FIG. 5 shows a cross section view taken at lines 5-5 of FIG. 1.

FIGS. 2 and 5 illustrate engagement between the floor plate 28 and the spacer 22. Floor plate 28 comprises a first tab 62 extending from the first end 36 of the floor plate, and a second tab 64 extending from the second end 38 opposite to the first end 36. As shown in FIG. 5, spacer 22 comprises a first shoulder 66 positioned at a first end 68 of the spacer, and a second shoulder 70 positioned at a second end 72 of the spacer. As shown in FIG. 5, the first tab 62 of the floor plate 28 engages the first shoulder 66 of the spacer 22, and the second tab 64 engages the second shoulder 70.

As shown in FIG. 5, additional engagement between the butt plate 16 and the floor plate 28 is provided by a third tab 74 which extends from the first end 36 of the floor plate 28. Third tab 74 engages a recess 76 in the butt plate 16 to prevent the butt plate from being peeled away from the floor plate 28.

As shown in FIG. 1, tube 12 also comprises a second end 78 oppositely disposed from the first end 18. Second end 78 defines a second opening 80 which receives ammunition (not shown) loaded into the central space 14. A follower 82 is positioned within the central space 14. The follower 82 is movable toward and away from the second end 78 of tube 12. As shown in FIGS. 1 and 2, a spring 84 acts between the floor plate 28 and the follower 82 for biasing the follower toward the second end 78 of the tube 12 to supply rounds of ammunition from magazine 10, used in a firearm, as the firearm cycles during firing.

The magazine 10 with the fastener and detent mechanism described herein is expected to improve the strength and simplicity of the attachment of the spacer to the magazine.

What is claimed is:

1. An ammunition magazine, said magazine comprising:

a tube surrounding a central space and having first and second ends oppositely disposed, a first opening being positioned at said first end of said tube providing access to said central space;

a butt plate attached to said first end of said tube and overlying said first opening;

a spacer surrounding said tube proximate to said first end thereof, said spacer engaging said butt plate;

a floor plate positioned within said tube and engaging said spacer;

a fastener acting between said butt plate and said floor plate, said fastener attaching said butt plate to said floor plate and capturing said spacer therebetween.

2. The magazine according to claim 1, wherein said tube comprises a pair of lips positioned opposite to one another at said first end thereof, said butt plate comprising a pair of slots positioned in spaced relation and opposite to one another, said slots receiving said lips for attaching said butt plate to said tube.

3. The magazine according to claim 1, wherein:

said floor plate comprises a first tab extending from a first end of said floor plate and a second tab extending from a second end of said floor plate opposite to said first end of said floor plate;

said spacer comprises a first shoulder positioned at a first end of said spacer and a second shoulder positioned at a second end of said spacer opposite to said first end of said spacer; wherein said first tab engages said first shoulder and said second tab engages said second shoulder.

4. The magazine according to claim 1, wherein said fastener comprises:

a slot positioned in said butt plate;

a projection extending from said floor plate toward said butt plate, said projection having a head in spaced relation to said floor plate, said head having a width wider than a width of said slot, said projection engaging said slot to retain said butt plate to said floor plate.

5. The magazine according to claim 4, wherein said slot extends along a line between said first and second ends of said floor plate.

6. The magazine according to claim 5, wherein said projection comprises a fin extending along a line between said first and said second ends of said floor plate.

7. The magazine according to claim 6, wherein said projection has a "T" shaped cross sectional shape.

8. The magazine according to claim 6, wherein:

said fin comprises a first recess extending transversely to said fin;

said butt plate comprises a first protrusion contiguous with said slot, said first recess receiving said first protrusion for retaining said fin within said slot.

9. The magazine according to claim 8, further comprising:

a second recess extending transversely to said fin in a opposite direction to said first recess;

a second protrusion contiguous with said slot, said second protrusion being positioned on an opposite side of said slot from said first protrusion, said second recess receiving said second protrusion for retaining said fin within said slot.

10. The magazine according to claim 1, further comprising:

a follower positioned within said central space and movable toward and away from said second end of said tube;

a spring acting between said follower and said floor plate for biasing said follower toward said second end of said tube.

11. The magazine according to claim 3, further comprising:

a third tab extending from said first end of said floor plate, said third tab being offset from said first tab toward said butt plate;

a recess positioned at a first end of said butt plate, said recess receiving said third tab for fixing said butt plate to said floor plate.

* * * * *